US007694471B2

(12) United States Patent
Meeks et al.

(10) Patent No.: US 7,694,471 B2
(45) Date of Patent: Apr. 13, 2010

(54) ASTRAGAL BOOT

(75) Inventors: James W. Meeks, Eaton, OH (US); David C. Bryant, Richmond, IN (US)

(73) Assignee: Quanex Corporation, Houston, TX (US)

( * ) Notice: Subject to any disclaimer, the term of this patent is extended or adjusted under 35 U.S.C. 154(b) by 49 days.

(21) Appl. No.: 11/690,617

(22) Filed: Mar. 23, 2007

(65) Prior Publication Data

US 2008/0229668 A1 Sep. 25, 2008

(51) Int. Cl.
*E06B 1/04* (2006.01)
*E04C 2/38* (2006.01)
*E06B 1/70* (2006.01)

(52) U.S. Cl. ..... 52/207; 52/206; 52/211; 52/717.01; 49/467; 49/504

(58) Field of Classification Search ..... 52/206, 52/207, 204.1, 211, 301, 717.01, 630; 49/467, 49/504

See application file for complete search history.

(56) References Cited

U.S. PATENT DOCUMENTS

| | | | | | |
|---|---|---|---|---|---|
| 588,626 | A | * | 8/1897 | Baumann | 49/467 |
| 1,811,848 | A | * | 6/1931 | Holmes | 105/280 |
| 3,282,006 | A | * | 11/1966 | Halsey et al. | 52/781 |
| 3,360,887 | A | * | 1/1968 | Parks et al. | 49/490.1 |
| 3,568,390 | A | * | 3/1971 | Swensen et al. | 52/789.1 |
| 4,387,535 | A | * | 6/1983 | Corbo | 49/468 |
| 4,429,493 | A | * | 2/1984 | St. Aubin | 49/367 |
| D273,090 | S | * | 3/1984 | Imperial | D8/400 |
| 4,573,287 | A | | 3/1986 | Hagemeyer et al. | |
| 4,590,723 | A | * | 5/1986 | Nassau et al. | 52/204.53 |
| 4,644,696 | A | * | 2/1987 | Bursk | 49/367 |
| 4,807,392 | A | * | 2/1989 | Kirk | 43/131 |
| 4,956,940 | A | * | 9/1990 | Touton, III | 49/388 |

(Continued)

FOREIGN PATENT DOCUMENTS

DE 10012762 C1 * 11/2001

(Continued)

OTHER PUBLICATIONS

U.S. Appl. No. 11/244,786, entitled "Astragal Boot", filed Oct. 6, 2005, 24 pages.

(Continued)

*Primary Examiner*—Robert J Canfield
(74) *Attorney, Agent, or Firm*—Howard & Howard Attorneys PLLC

(57) ABSTRACT

An astragal boot for mounting onto a lower end of an astragal includes a platform, a first and second lateral fin spaced from each other and projecting downwardly from the platform, and an auxiliary fin disposed between the first and second lateral fins. The auxiliary fin defines an auxiliary fin edge extending from the first lateral fin to the second lateral fin for sealing engagement with the threshold. The auxiliary fin includes a hub portion and a first and second leg portion each extending from the hub portion to the first and second lateral fins, respectively. The first leg portion extends along a first direction defining a portion of the auxiliary fin edge along the first direction and the second leg portion extends along a second direction at an obtuse angle relative to the first direction defining another portion of the auxiliary fin edge along the second direction.

32 Claims, 9 Drawing Sheets

U.S. PATENT DOCUMENTS

| | | | | |
|---|---|---|---|---|
| 5,396,735 | A * | 3/1995 | Dietrich | 49/499.1 |
| 5,457,929 | A * | 10/1995 | Kim | 52/834 |
| 5,481,076 | A * | 1/1996 | Mullet et al. | 200/61.43 |
| 5,857,291 | A | 1/1999 | Headrick | |
| 5,943,825 | A * | 8/1999 | Procton et al. | 49/469 |
| 6,052,949 | A * | 4/2000 | Procton et al. | 49/506 |
| 6,219,971 | B1 | 4/2001 | Headrick | |
| 6,491,326 | B1 * | 12/2002 | Massey et al. | 292/162 |
| 6,612,082 | B2 * | 9/2003 | Schimmelpfennig et al. | 52/300 |
| 6,637,158 | B2 * | 10/2003 | Bennett | 49/504 |
| 6,666,486 | B1 | 12/2003 | Fleming | |
| 6,763,639 | B2 * | 7/2004 | Bennett et al. | 52/212 |
| 6,804,921 | B2 * | 10/2004 | Neylon | 52/244 |
| 7,140,154 | B2 * | 11/2006 | Governale et al. | 52/207 |
| D541,629 | S * | 5/2007 | Pepper et al. | D8/331 |
| D544,337 | S * | 6/2007 | Pepper et al. | D8/331 |
| 7,263,808 | B2 * | 9/2007 | Massey et al. | 52/204.1 |
| 7,284,353 | B2 * | 10/2007 | Bealko | 52/656.5 |
| 7,296,383 | B2 * | 11/2007 | Schiedegger et al. | 52/202 |
| 2003/0052492 | A1 * | 3/2003 | Massey et al. | 292/341.15 |
| 2004/0128925 | A1 * | 7/2004 | Massey | 52/204.1 |
| 2004/0139667 | A1 * | 7/2004 | Massey et al. | 52/204.1 |
| 2004/0256858 | A1 * | 12/2004 | Governale et al. | 292/1 |
| 2005/0005543 | A1 * | 1/2005 | Ribic | 52/204.1 |
| 2005/0116424 | A1 | 6/2005 | Sanders | |
| 2005/0120630 | A1 * | 6/2005 | Sanders | 49/365 |
| 2005/0120631 | A1 * | 6/2005 | Sanders | 49/367 |
| 2005/0193784 | A1 | 9/2005 | Sanders | |
| 2005/0198911 | A1 * | 9/2005 | Baczuk et al. | 49/504 |
| 2006/0150517 | A1 * | 7/2006 | Meeks et al. | 49/368 |
| 2007/0180784 | A1 * | 8/2007 | Smith | 52/300 |
| 2008/0028701 | A1 * | 2/2008 | White | 52/207 |

FOREIGN PATENT DOCUMENTS

| | | | |
|---|---|---|---|
| EP | 288756 | A1 * | 11/1988 |
| EP | 304592 | A1 * | 3/1989 |
| EP | 569986 | A1 * | 11/1993 |
| EP | 628694 | A1 * | 12/1994 |
| GB | 2147647 | A * | 5/1985 |
| GB | 2248648 | A * | 4/1992 |

OTHER PUBLICATIONS

U.S. Appl. No. 29/239,952, entitled "Astragal Boot", filed Oct. 6, 2005, 4 pages.
U.S. Appl. No. 29/239,972, entitled "Astragal Boot", filed Oct. 6, 2005, 4 pages.

* cited by examiner

ASTRAGAL BOOT

BACKGROUND OF THE INVENTION

1. Field of the Invention

The present invention generally relates to an astragal boot for mounting onto a lower end of an astragal disposed at a free end of a semi-active door in a double-door set disposed over a threshold.

2. Description of the Related Art

Various astragal assemblies are known in the prior art to include an astragal and an astragal boot attached to the astragal. The astragal assembly is disposed between an active door and a semi-active door of a double-door set. The double-door set is disposed over a threshold in a door opening of a building. Typically, the astragal is mounted onto a free end of the semi-active door such that the astragal moves with the free end as the semi-active door is swung between an open position and a closed position. The astragal presents a lower end proximal to the threshold when the semi-active door is in the closed position and walls extending upwardly from the lower end defining a profile.

The astragal boot typically includes a platform and a plurality of projections complementary to the profile projecting upwardly from the platform into engagement with the walls for retaining the astragal boot to the lower end of the astragal.

Door sweeps are mounted on a bottom edge of the semi-active door and the active door. The door sweeps seal between the bottom edge of the doors and the threshold to prevent penetration of elements, i.e. water, draft, and debris, into the building. The prior art discloses an astragal boot that includes fins extending downwardly from the platform of the astragal boot to overlap the door sweeps on the semi-active door and the active door and to seal against the threshold. Specifically, U.S. Patent Application Publication 2004/0256858 to Governale discloses an astragal boot including a platform and two head fins projecting from the platform to overlap and engage the door sweeps on the active door and the semi-active door and to seal against the threshold. The head fins are flexible to flex against the threshold to seal against the threshold and to minimize the effort required to close the semi-active door over the threshold. A pair of lateral fins are spaced from one another and project from the platform. The lateral fins are not joined to the head fins. Further, the astragal boot does not include additional fins disposed between the lateral fins to define subcavities between the lateral fins. Because the head fins are flexible, it is possible for water to leak between the head fins and the door sweeps. In addition, due to the flexibility of the head fins, it is possible for the head fins to be obstructed by debris thereby preventing a water-tight seal against the threshold and allowing water to leak past the head fins. Because the lateral fins are not joined to the head fins, water that leaks past the head fins may leak into the building between the astragal boot and the threshold.

It is desirable to manufacture an astragal boot that seals between the door sweeps on the active door and the semi-active door while also providing a water-tight seal between the astragal boot and the threshold to prevent the penetration of water between the astragal boot and the threshold.

SUMMARY OF THE INVENTION AND ADVANTAGES

The present invention is an astragal boot for mounting onto a lower end of an astragal that is disposed at a free end of a semi-active door in a double door set disposed over a threshold. The astragal boot includes a platform and a first and a second lateral fin. The first and second lateral fins are spaced from each other and project downwardly from the platform for sealing engagement with the threshold. The astragal boot further includes an auxiliary fin disposed between the first and second lateral fins. The auxiliary fin defines an auxiliary fin edge extending from the first lateral fin to the second lateral fin for sealing engagement with the threshold. The auxiliary fin includes a first and second leg portion defining a first and second edge section of the auxiliary fin edge, respectively. The first leg portion extends along a first direction defining the auxiliary fin edge along the first direction. The second leg portion extends along a second direction at an obtuse angle relative to the first direction and defining the auxiliary fin edge along the second direction.

Accordingly, the astragal boot is an improvement upon the prior art. When the astragal boot is disposed over the threshold, the auxiliary fin edge sealingly engages the threshold to prevent the elements, such as water, draft, and dirt, from passing between the astragal boot and the threshold. Because the auxiliary fin edge extends from the first lateral fin to the second lateral fin, the auxiliary fin edge sealingly engages the threshold between the first lateral fin and the second lateral fin.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, an astragal assembly is shown generally at 20.

Figure 1:
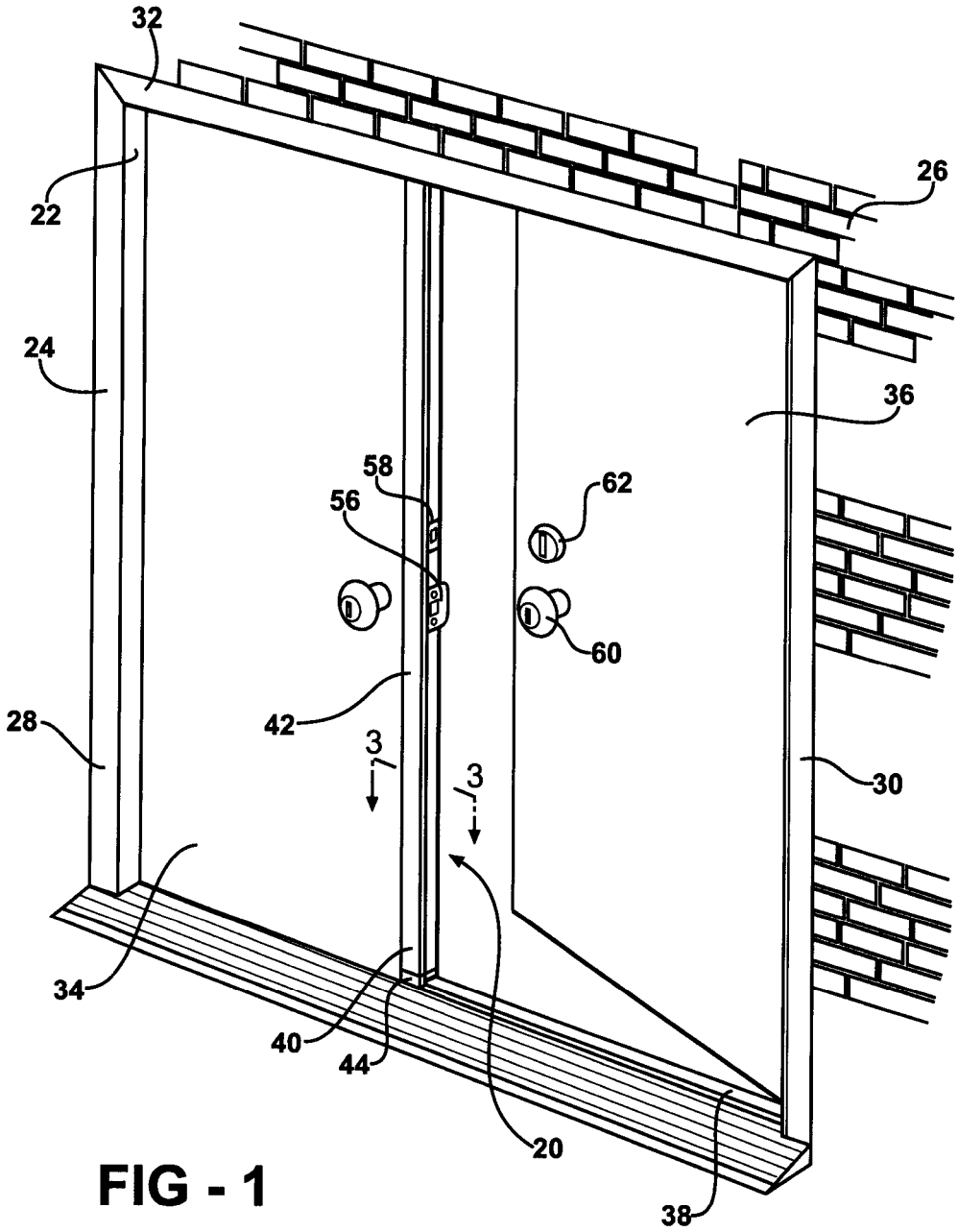
FIG. 1 is a perspective view of an astragal assembly disposed in a door assembly.

As shown in FIG. 1, the astragal assembly 20 is mounted in a door assembly 22. The door assembly 22 may include a frame 24 and a double-door set mounted to the frame 24. The frame 24 may be mounted in a door opening of a building 26, such as a commercial or residential building 26. In such a configuration, the frame 24 includes a first vertical member 28, a second vertical member 30 spaced from and in parallel with the first vertical member 28, and a header 32 extending between the first vertical member 28 and the second vertical member 30. The double-door set includes a semi-active door 34 rotatably mounted to the first vertical member 28 of the frame 24 and an active door 36 rotatably mounted to the second vertical member 30 of the frame 24. The semi-active door 34 and the active door 36 are rotatable relative to the first vertical member 28 and the second vertical member 30, respectively, such that the doors 34, 36 may independently swing between an open position and a closed position. A threshold 38 may be mounted in the door opening of the building 26 below the door assembly 22 such that the threshold 38 extends between the first vertical member 28 and the second vertical member 30 of the frame 24.

Figure 2:
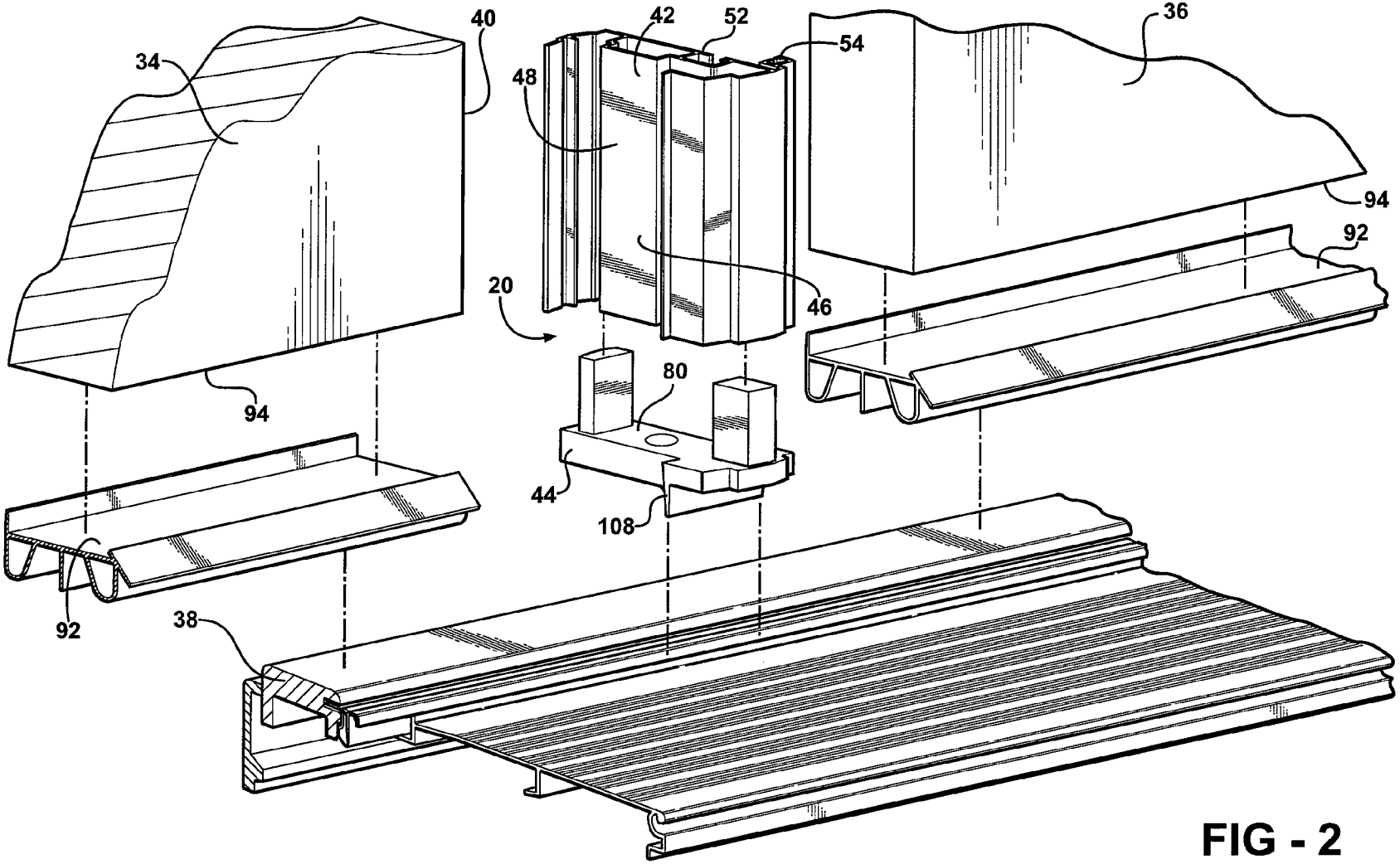
FIG. 2 is an exploded view of a portion of the astragal assembly and the door assembly shown in FIG. 1 with doors of the door assembly in a closed position.
Figure 3:
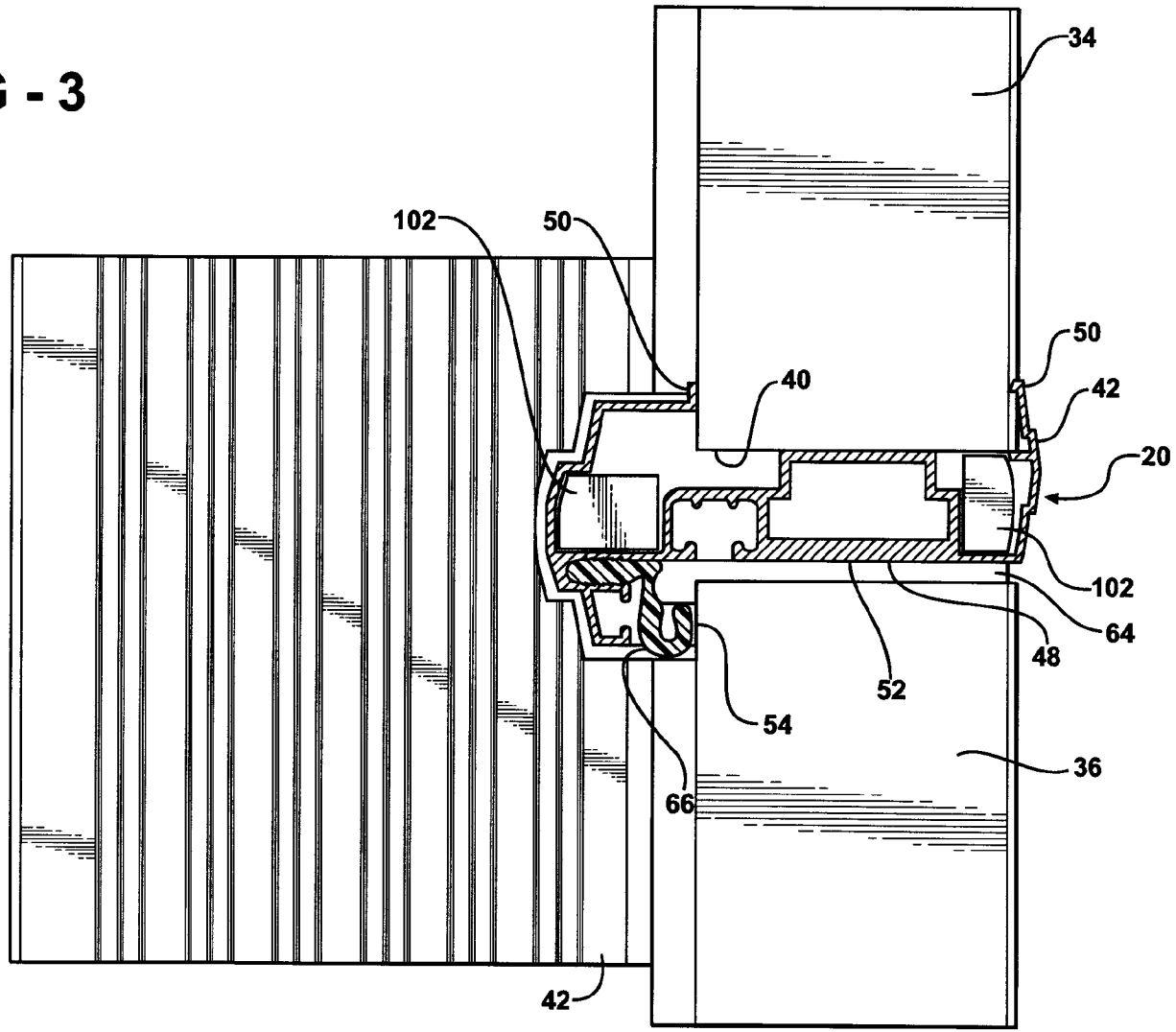
FIG. 3 is a partial cross-sectional view of the astragal assembly and a portion of the door assembly generally taken along line 3-3 in FIG. 1 with doors of the door assembly in the closed position.
Figure 4:
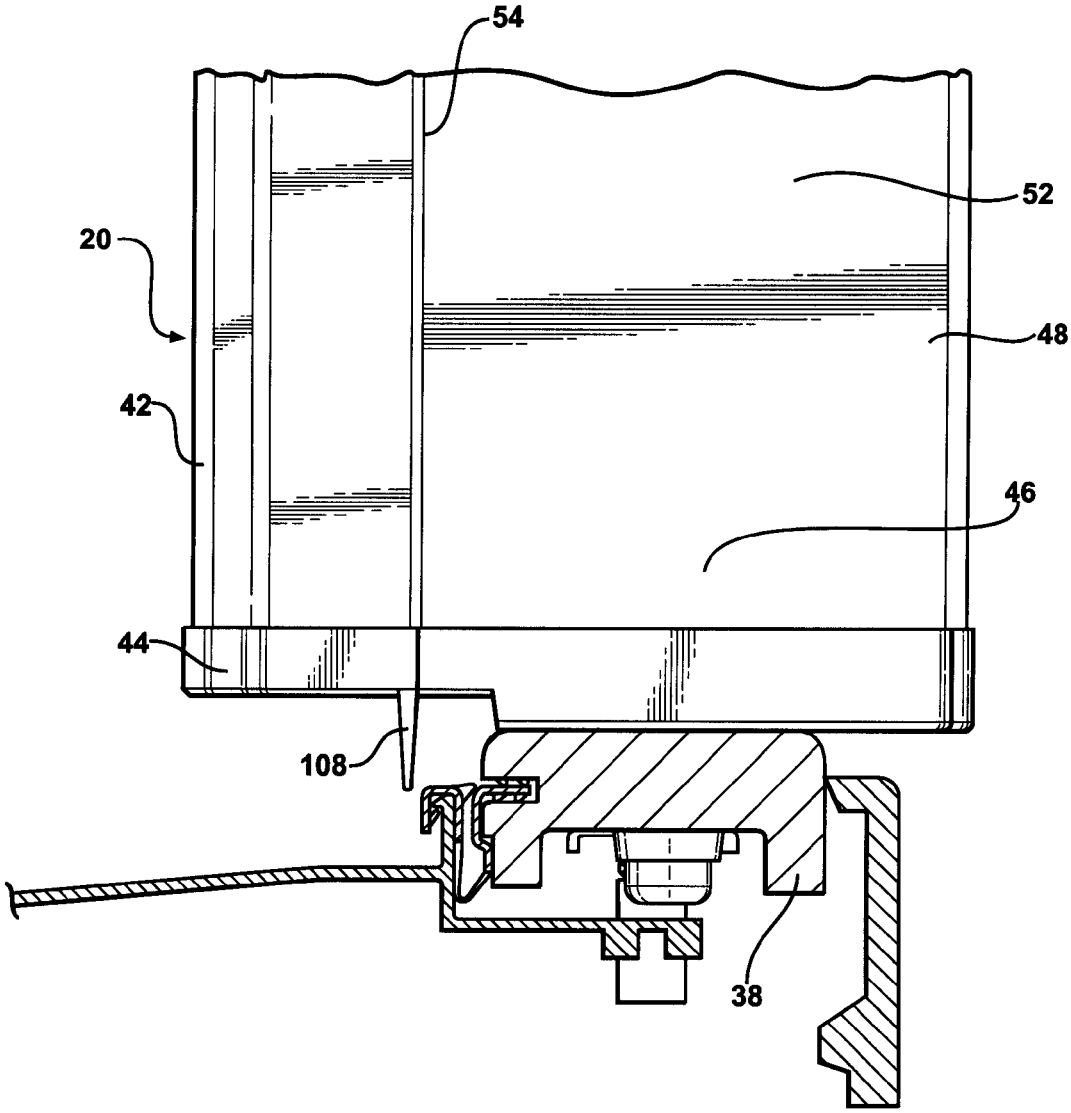
FIG. 4 is a side view of the astragal assembly including an astragal boot with a portion of the door assembly shown in cross-section.
Figure 5:
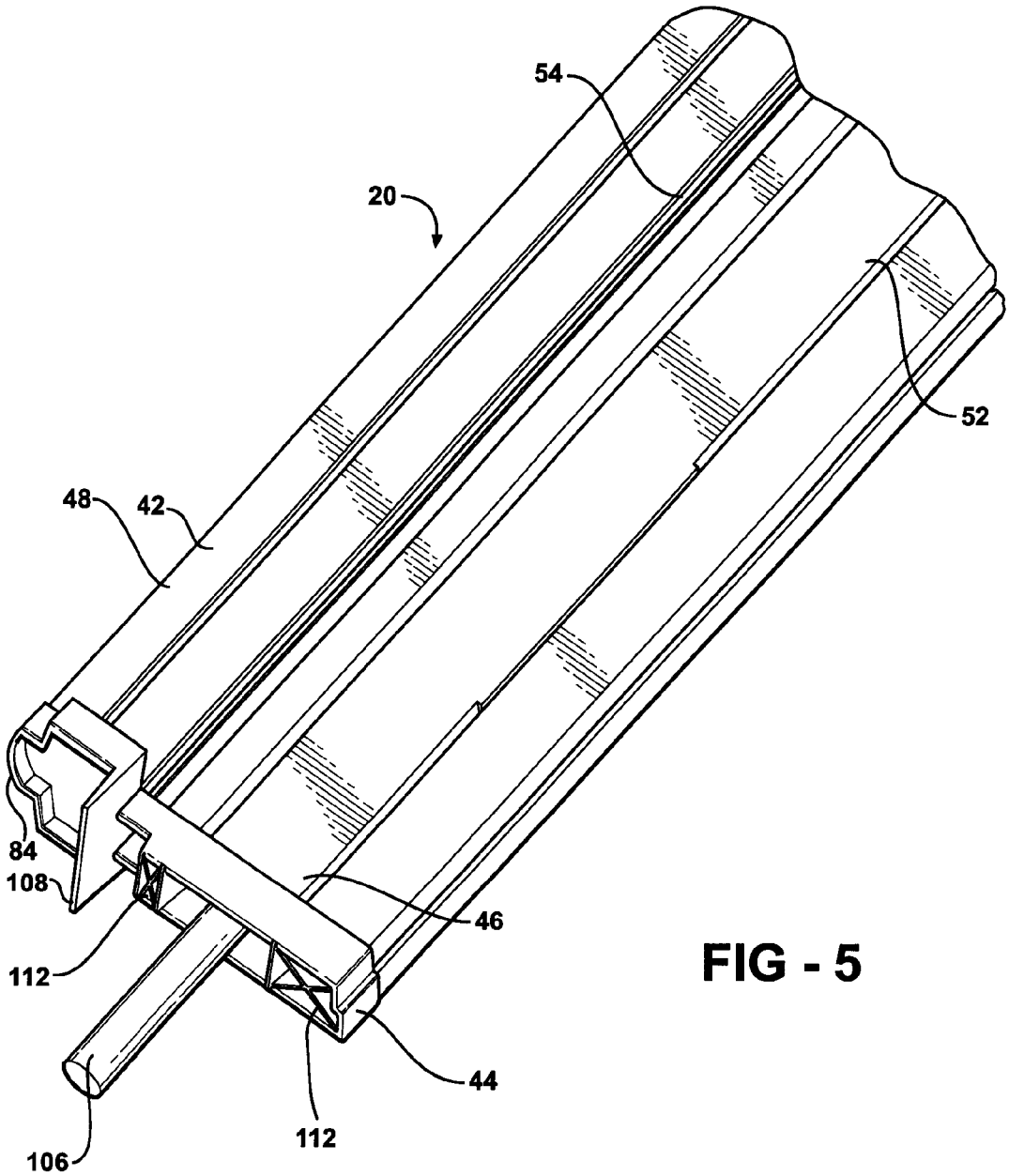
FIG. 5 is a perspective view of a portion of the astragal assembly including the astragal boot.

As shown in FIG. 1-3, the astragal assembly 20 is disposed on a free end 40 of the semi-active door 34 in the double-door set disposed over the threshold 38. The astragal assembly 20 includes an astragal 42 disposed on the free end 40 of the semi-active door 34 and an astragal boot 44 for mounting onto a lower end 46 of the astragal 42. The astragal assembly 20 extends between the active door 36 and the semi-active door 34 from the threshold 38 to the header 32 when the doors are in the closed position. The astragal boot 44 seals against the threshold 38 and the astragal 42 extends upwardly from the astragal boot 44 to the header 32 between the doors 34, 36.

Specifically, the astragal 42 presents the lower end 46 proximal to the threshold 38 and walls 48 extending upwardly from the lower end 46. As shown in FIG. 3, the walls 48 of the astragal 42 define a profile. The profile may include a pair of opposing fingers 50 that engage the semi-active door 34 to attach the astragal 42 to the free end 40 of the semi-active door 34. The astragal 42 is attached to the semi-active door 34 such that the astragal 42 moves with the free end 40 of the semi-active door 34 when the semi-active door 34 is swung between the open position and the closed position. The astragal 42 presents a first inside surface 52 and a second inside surface 54 extending from the first inside surface 52. The first inside surface 52 and the second inside surface 54 are configured such that a corner of the active door 36 abuts the first inside surface 52 and the second inside surface 54 when the active door 36 and the semi-active door 34 are in the closed position.

As shown in FIG. 1, a strike plate 56 and a deadbolt strike 58 may be mounted on the first inside surface 52 of the astragal 42. In such a configuration, the strike plate 56 is aligned along the first inside surface 52 to receive a latch from a door knob 60 assembly on the active door 36 when the active door 36 and the semi-active door 34 are in the closed position. When both the active door 36 and the semi-active door 34 are in the closed position, the latch from the door knob 60 assembly engages the strike plate 56 on the semi-active door 34 to engage the active door 36 to the semi-active door 34. A door knob 60 on the door knob 60 assembly may be turned to disengage the latch from the strike plate 56 thereby disengaging the active door 36 from the semi-active door 34. Likewise, the deadbolt strike 58 is aligned along the first inside surface 52 to receive a deadbolt from a deadbolt assembly 62 on the active door 36 when the active door 36 and the semi-active door 34 are in the closed position and the deadbolt is in a locked position.

As shown in FIG. 3, a corner pad 64 may be attached to the first inside surface 52 of the astragal 42 and to the astragal boot 44. The corner pad 64 contacts the threshold 38 when the semi-active door 34 is in the closed position. A weather seal 66 extends along the second inside surface 54 of the astragal 42. The weather seal 66 may fold over a portion of the corner pad 64. When the semi-active door 34 and the active door 36 are in the closed position the corner pad 64 and the weather seal 66 prevent the elements, i.e. water, draft, and debris, from penetrating between the active door 36 and the astragal 42.

As shown in FIGS. 5 and 6-9, the astragal boot 44 includes a platform 68. The platform 68 is defined by a head portion 70 presenting a straight edge having opposite ends and a base portion 80 having sides narrower than the head portion 70. The base portion 80 extends from the straight edge along an axis generally perpendicular to the straight edge to a distal extremity 82. The head portion 70 defines a skirt 84 projecting downwardly. It should be appreciated that the head portion 70 may extend generally perpendicular to the base portion 80 and the angle between the head portion 70 and the base portion 80 may have any magnitude without departing from the nature of the present invention.

The astragal boot 44 includes a first lateral fin 86 and a second lateral fin 88 spaced from each other. The first and second lateral fins 86, 88 project downwardly from the platform 68 for sealing engagement with the threshold 38. The first and second lateral fins 86, 88 may extend in parallel relationship to one another; however, it should be appreciated that the lateral fins 86, 88 may extend at any angle relative to each other without departing from the nature of the present invention. The first and second lateral fins 86, 88 and the platform 68 define a primary cavity 90.

The door sweeps 92 may extend along a bottom edge 94 of each door to seal between the bottom edge 94 of each door and the threshold 38 when the doors are in the closed position. The door sweeps 92 prevent elements from penetrating between the doors 34, 36 and the threshold 38 into the building 26. Specifically, the door sweep 92 on the semi-active door 34 extends along the bottom edge 94 of the semi-active door 34 between the first vertical member 28 of the frame 24 and the corner pad 64. When both the semi-active door 34 and the active door 36 are in the closed position, the door sweep 92 on the bottom edge 94 of the active door 36 extends along the bottom edge 94 of the active door 36 between the second vertical member 30 of the frame 24 to the astragal 42 and the astragal boot 44. The door sweeps 92 contact and seal against the first and second lateral fins 86, 88 to prevent the elements from penetrating between the door sweeps 92 and the astragal boot 44 into the building 26.

As shown in FIGS. 2-3, the astragal boot 44 includes an attachment device 96 attaching the astragal boot 44 to the astragal 42. For example, the attachment device 96 may include a plurality of projections 98 projecting upwardly from the platform 68 for engaging the astragal 42. The plurality of projections 98 may be complementary to the profile of the astragal 42 and project upwardly from the platform 68 in engagement with the walls 48 of the astragal 42 for retaining the astragal boot 44 to the lower end 46 of the astragal 42. The plurality of projections 98 may include a first projection 100 and a second projection 102 spaced from the first projection 100. In such a configuration, the first projection 100 may project upwardly from the head portion 70 of the platform 68 and the second projection 102 may project upwardly from the base portion 80 of the platform 68. The projections 100, 102 may be tapered such that the projections 100, 102 are press fit into the profile against the walls 48 of the astragal 42. For example, the projections 100, 102 may be cross-shaped and upwardly tapering such that the projections 100, 102 engage the walls 48 of the astragal 42. The astragal boot 44 may be removable from the lower end 46 of the astragal 42 such that the astragal boot 44 may be replaced if the astragal boot 44 becomes damaged or worn.

The platform 68 may define a hole 104 spaced from the straight edge of the head portion 70 of the platform 68 and from the distal extremity 82 of the base portion 80 of the platform 68. In such a configuration, the hole 104 allows for a lock bolt 106 to be slid through the hole 104. Specifically, in such a configuration, the lock bolt 106 is slideable within the astragal 42 and when the semi-active door 34 is in the closed position the lock bolt 106 may be slid along the astragal 42 and through the hole 104 in the platform 68 to engage a keeper in the threshold 38. The engagement of the lock bolt 106 in the keeper prevents the semi-active door 34 from rotating. The semi-active door 34 may rotate relative to the frame 24 of the door assembly 22 when the lock bolt 106 is disengaged with the keeper in the threshold 38.

As shown in FIGS. 6-9, the astragal boot 44 includes a head fin 108. The head fin 108 is flexible and projects downwardly from the platform 68 between the opposite ends of the straight edge of the head portion 70 of the platform 68 for parallel and overlapping sealing engagement with the door sweeps 92.

The astragal boot 44 defines a channel 110 for receiving the head fin 108 in the channel 110 when the head fin 108 flexes against the threshold 38 and into the channel 110 when the head fin 108 passes over the threshold 38. More specifically, when the semi-active door 34 and the astragal 42 assembly are swung from an open position to a closed position, the head fin 108 passes over the threshold 38. The head fin 108 contacts the threshold 38 and flexes against the threshold 38 and into the channel 110 as the swing of the semi-active door 34 and the astragal assembly 22, 20 is continued.

An auxiliary fin 112 is disposed between the first and second lateral fins 86, 88. Specifically, the auxiliary fin 112 is disposed in the primary cavity 90 and extends downwardly relative to the platform 68. The auxiliary fin 112 divides the primary cavity 90 into subcavities 114. Each subcavity 114 is defined by the first and second lateral fins the platform 68, and the auxiliary fin 112. In other words, the auxiliary fin 112 is positioned along the platform 68 as to divide the platform 68 such that each subcavity 114 is defined by first and second lateral fins 86, 88, the platform 68, and the auxiliary fin 112. It should be appreciated that the astragal boot 44 may include a plurality of auxiliary fins 112 without departing from the nature of the present invention. For example, FIGS. 6-9 each show the astragal boot 44 including a pair of auxiliary fins 114.

The auxiliary fin 112 includes a hub portion 116 and a plurality of leg portions. Specifically, the plurality of leg portions includes a first leg portion 120 and a second leg portion 122. The hub portion 116 is spaced from the first and second lateral fins 86, 88 with each of the first and second leg portions 120, 122 extending from the hub portion 116. Specifically, the first leg portion 120 extends from the hub portion 116 to the first lateral fin 86 and the second leg portion 122 extends from the hub portion 116 to the second lateral fin 88. It should be appreciated that each of the plurality of leg portions may have the same or varying lengths relative to each other. It should also be appreciated that the auxiliary fin 112 may include a plurality of hub portions.

The hub portion 116 is further defined as an intersection of the plurality of leg portions. The hub portion 116 may be spaced an equal distance from the first lateral fin 86 and the second lateral fin 88. Alternatively, the hub portion 116 may be spaced closer to either of the first or second lateral fins 86, 88. It should be appreciated that the hub portion 116 may be of any thickness. Specifically, the hub portion 116 may define a thickness greater than, less than, or equal to that of each of the leg portions. It should also be appreciated that the hub portion 116 may have more, less, or the same flexibility as each of the leg portions.

The hub portion 116 may provide reinforcement for each of the plurality of leg portions. In other words, because the hub portion 116 is the intersection of the plurality of leg portions, the hub portion 116 may be less flexible than the leg portions because each leg portion will constrain the direction that the hub portion 116 may flex in. As such, the hub portion 116 may reinforce the leg portions to urge the leg portions in contact with the threshold 38.

The auxiliary fin 112 defines an auxiliary fin edge 124 extending from the first lateral fin 86 to the second lateral fin 88 for sealing engagement with the threshold 38. Each of the plurality of leg portions defines a plurality of edge sections of the auxiliary fin edge 124. Specifically, the first and second leg portions 120, 122 define a first edge section 128 and a second edge section 130 of the auxiliary fin edge 124, respectively. The hub portion 116 defines a hub edge section 132 of the auxiliary fin edge 124. The first edge section 128 of the auxiliary fin edge 124 extends from the hub edge section 132 to the first lateral fin 86 and the second edge section 130 of the auxiliary fin edge 124 extends from the hub edge section 132 to the second lateral fin 88. The combination of the hub edge section 132, the first edge section 128, and the second edge section 130 extend continuously from the first lateral fin 86 to the second lateral fin 88.

When the semi-active door 34 and the active door 36 are in the closed position, the astragal boot 44 seals against the threshold 38 between the door sweep 92 on the semi-active door 34 and the door sweep 92 on the active door 36. The door sweeps 92 on the active door 36 and the semi-active door 34 seal against the lateral fins 86, 88 such that elements may not penetrate between the door sweeps 92 and the lateral fins 86, 88 and into the building 26. In other words, the astragal boot 44 continuously seals against the threshold 38 between the first vertical member 28 and the second vertical member 30 of the frame 24 to prevent penetration of elements into the building 26.

Specifically, the head fin 108 may reduce or prevent elements from penetrating between the astragal boot 44 and the threshold 38 into the building 26. The auxiliary fin 112 and the first and second lateral fins 86, 88 prevent further penetration of the elements that penetrate between the head fin 108 and the threshold 38 from penetrating below the astragal boot 44 and into the building 26. Specifically, the auxiliary fin edge 124 defined by the auxiliary fin 112 seals against the threshold 38 to prevent the elements from passing below the astragal boot 44 and into the building 26.

The first leg portion 120 extends from the hub portion 116 to the first lateral fin 86 along a first direction D1 defining the auxiliary fin edge 124 along the first direction D1. The second leg portion 122 extends from the hub portion 116 to the first lateral fin 86 along a second direction D2 at an obtuse angle AO relative to the first direction D1 defining the auxiliary fin edge 124 along the second direction D2. It should be appreciated that the first and second leg portions 120, 122 ultimately extend in the first and second direction D2 respectively. In other words, the first and second leg portions 120, 122 need not extend along a straight line in the first and second directions D1, D2, respectively, but may extend along any path wherein the first and second leg portions 120, 122 ultimately extend along the first and second direction D1, D2, respectively.

The first direction D1 extends at a first angle A1 relative to the first lateral fin 86 and the first leg portion 120 extends to the first lateral fin 86 at the first angle A1 relative to the first lateral fin 86. The second direction D2 extends at a second angle A2 relative to the second lateral fin 88 and the second leg portion 122 extends to the second lateral fin 88 at the second angle A2 relative to the second lateral fin 88. The first angle A1 and the second angle A2 may have an equal magnitude. Alternatively, the first angle A1 and the second angle A2 may have different magnitudes.

For example, both of the first angle A1 and the second angle A2 may be non-right angles. Alternatively, one of the first and second angles A1, A2 may a non-right angle and other of the first and second angles A1, A2 may be a right angle. It should be appreciated that the term "right angle" is used herein to describe an angle having a magnitude of 90° and the term "non-right angle" is used herein to describe an angle having a magnitude of more or less than 90°.

The plurality of leg portions of the auxiliary fin 112 may include a third leg portion 134 extending from the hub portion 116 to the first lateral fin 86 and a fourth leg portion 136 extending from the hub portion 116 to the second lateral fin 88. In such a configuration, the auxiliary fin edge 124 is defined by the hub portion 116 and the leg portions.

For example, one of the leg portions may become worn or obstructed by debris such that water may leak between the worn/obstructed leg portion and the threshold 38. The third and fourth leg portion 134, 136 increase the likelihood of prevention of penetration of the elements between the astragal boot 44 and the threshold 38 and into the building 26. For example, if the first leg portion 120 becomes worn or obstructed, the elements that penetrate between the first leg portion 120 and the threshold 38 will be prevented from penetrating into building 26 by the third leg portion 134. Likewise, for example, if the second leg portion 122 becomes worn or obstructed, the elements that penetrate between the second leg portion 122 and the threshold 38 will be prevented from penetrating into the building 26 by the fourth leg portion 136.

The third and fourth leg portion 134, 136 may extend in any direction from the hub portion 116 to the first and second lateral fins 86, 88, respectively. For example, the first, second, third, and fourth leg portions 120, 122, 134, 136 may define an X-shaped configuration. Specifically, the third leg portion 134 may extend from the hub portion 116 to the first lateral fin 86 in parallel with the first leg portion 120 and the fourth leg portion 136 may extend from the hub portion 116 to the second lateral fin 88 in parallel with the second leg portion 122.

It should be appreciated that the plurality of leg portions may include any number of leg portions. Each additional leg portion increases the likelihood that the auxiliary fin will prevent the penetration of the elements between the astragal boot 44 and the threshold 38 and into the building 26.

Each of the plurality of leg portions includes a distal end 74. The distal end 74 of the first leg portion 120 may be joined to the first lateral fin 86 and the distal end 74 of the second leg portion 122 may be joined to the second lateral fin 88. In other words, the first and second leg portions 120, 122 may be attached at the distal end 74 to the first and second lateral fins 86, 88, respectively. For example, the first and second leg portions 120, 122 may be formed as a unit with the first and second lateral fins 86, 88, respectively. Alternatively, first and second leg portions 120, 122 may be discontinuous with the first and second lateral fins 86, 88, respectively. In such a configuration, the distal end 74 of the first and second leg portions 120, 122 may be adjacent to and in contact with the first and second lateral fins 86, 88, respectively. For example, the first and second leg portions 120, 122 may be discontinuous from the first and second lateral fins 86, 88 and tightly pressed against the first and second lateral fins 86, 88, respectively.

Figure 8:
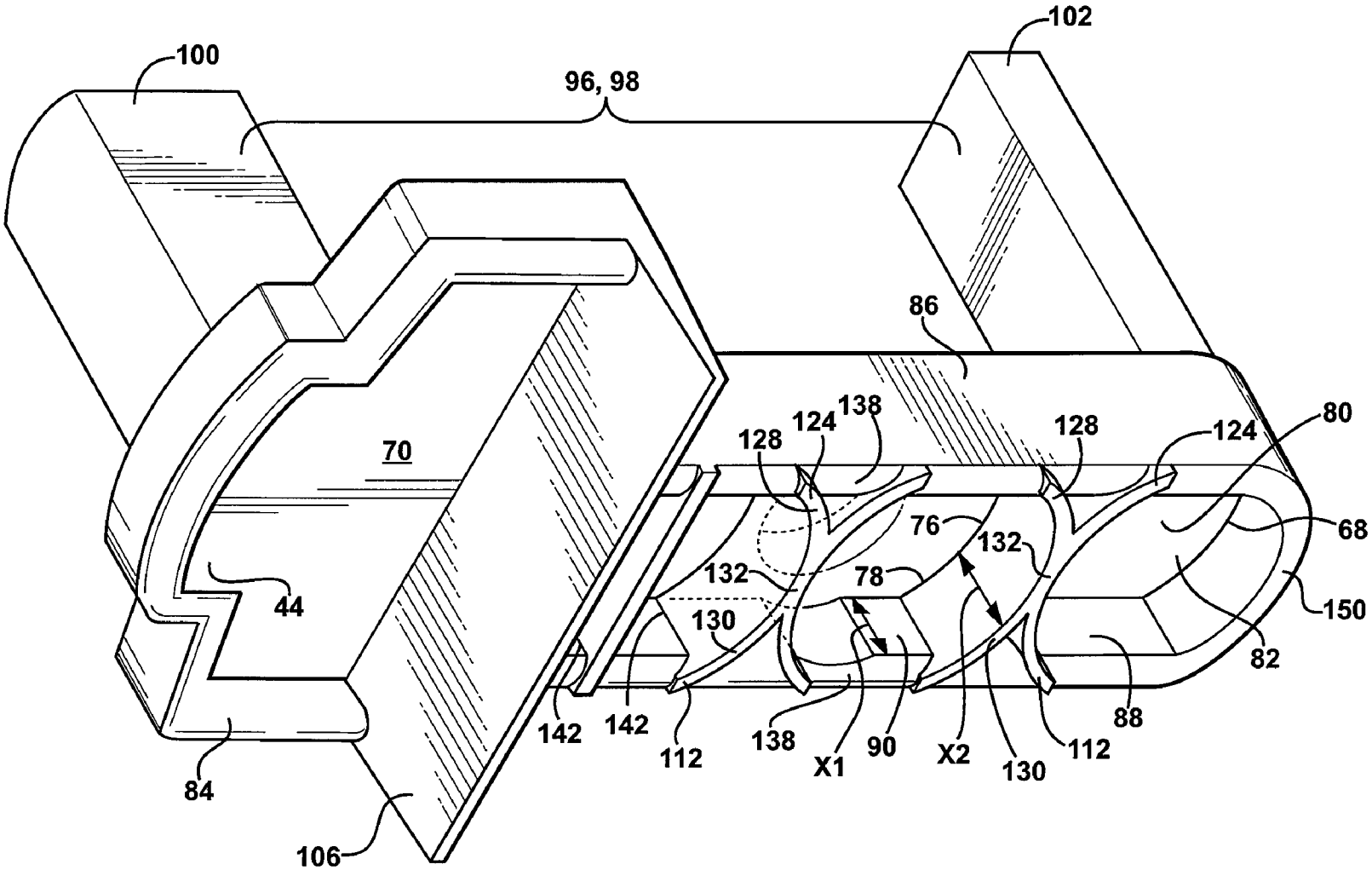
FIG. 8 is a perspective view of another embodiment of the astragal boot.
Figure 9:
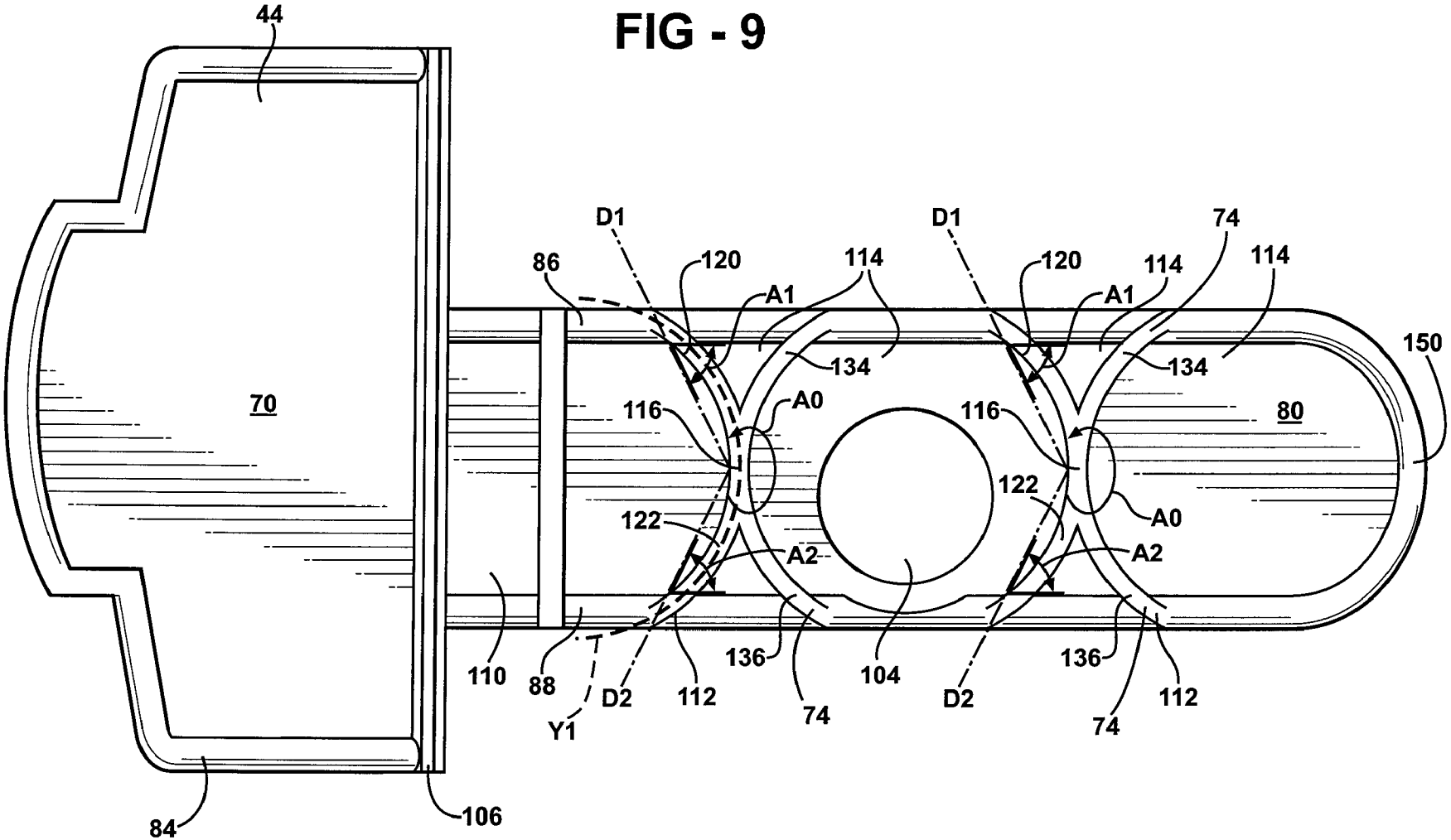
FIG. 9 is a bottom view of the astragal boot shown in FIG. 8.

Each of the first and second lateral fins 86, 88 presents a lateral fin edge 138 and extends in a downward direction from the platform 68 to the lateral fin edge 138. Each of the first and second lateral fins 86, 88 defines a first distance X1 between the platform 68 and the lateral fin edge 138. The auxiliary fin 112 defines a second distance X2 between the platform 68 and the auxiliary fin edge 124. As shown in FIGS. 8 and 9, the second distance X2 between the platform 68 and the auxiliary fin edge 124 may be greater than the first distance X1 between the platform 68 and each of the lateral fin edges 138 for flexing against the threshold 38 in sealing engagement with the threshold 38. In such a configuration, the auxiliary fin 112 is flexible between an unflexed position and a flexed position for flexing against the threshold 38. In other words, the auxiliary fin 112 is flexible such that when the semi-active door 34 is in the closed position, the auxiliary fin 112 flexes against the threshold 38. The lateral fins 86, 88 hold the auxiliary fin 112 in contact with the threshold 38. The effort required to swing the semi-active door 34 to the closed position is affected minimally because the auxiliary fin 112 is flexible and may flex easily against the threshold 38. Alternatively, as shown in FIGS. 6 and 7, the second distance X2 between the platform 68 and the auxiliary fin edge 124 may be equal to the first distance X1 between the platform 68 and each of the lateral fin edges 138.

The hub portion 116 may be integral with each of the plurality of leg portions. In other words, the hub portion 116 and plurality of leg portions may be formed as a single continuous unit. Alternatively, the hub portion 116 and the plurality of leg portions may be formed individually and subsequently joined together The hub portion 116 may include a joined hub end 76 joined to the platform 68. The hub portion 116 may be integral with the platform 68, i.e formed as a single continuous unit with the platform 68. Alternatively, the hub portion 116 may be formed separately from the platform 68 and subsequently joined to the platform 68 at the joined hub end 76.

Each of the plurality of leg portions may include a joined leg end 78 joined to the platform 68. The plurality of leg portions may be integral with the joined hub end 76, i.e formed as a single continuous unit with the platform 68. Alternatively, the plurality of leg portions may be formed separately from the platform 68 and subsequently joined to the platform 68 at the joined leg end 78.

Figure 6:
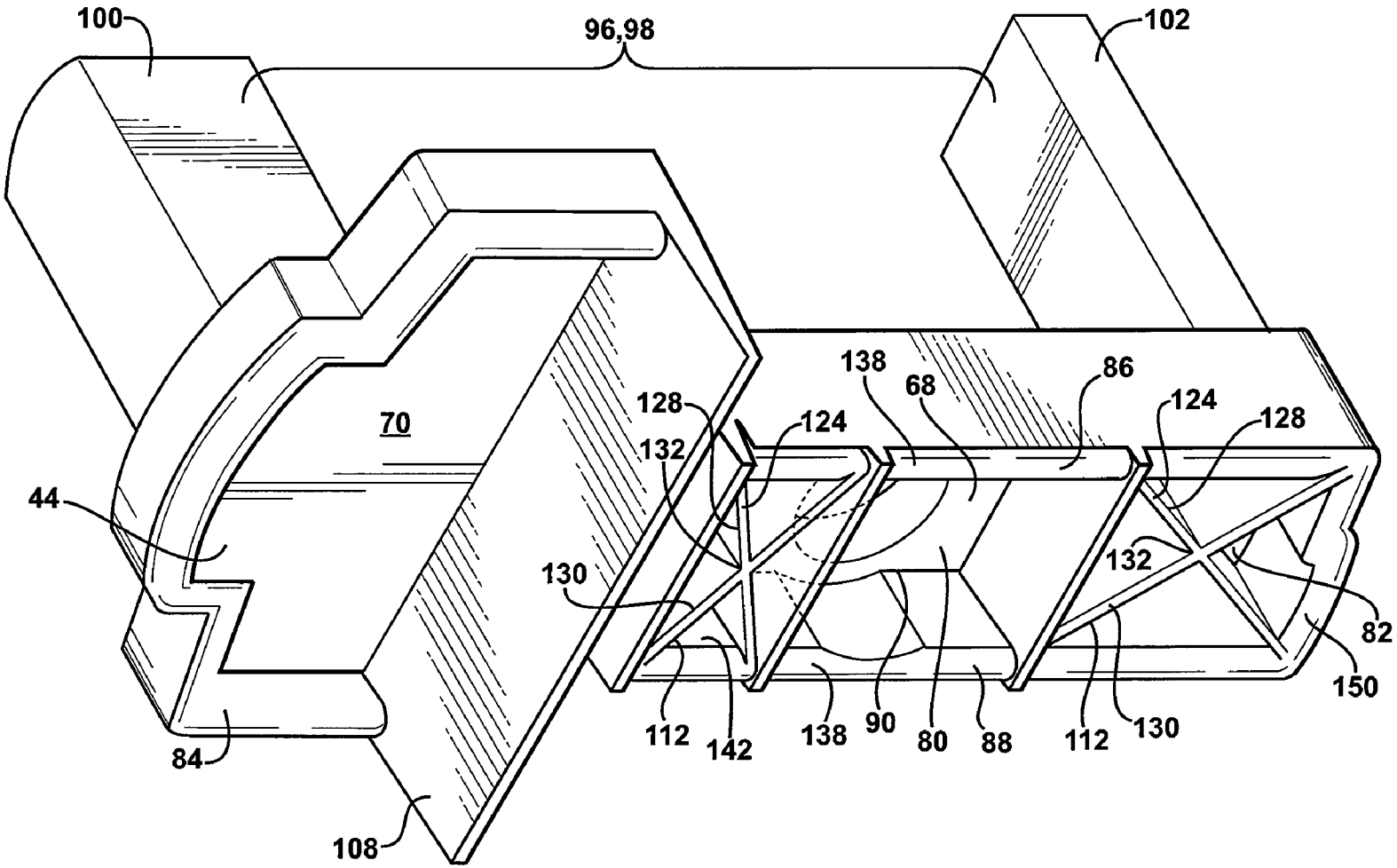
FIG. 6 is a perspective view of the astragal boot.
Figure 7:
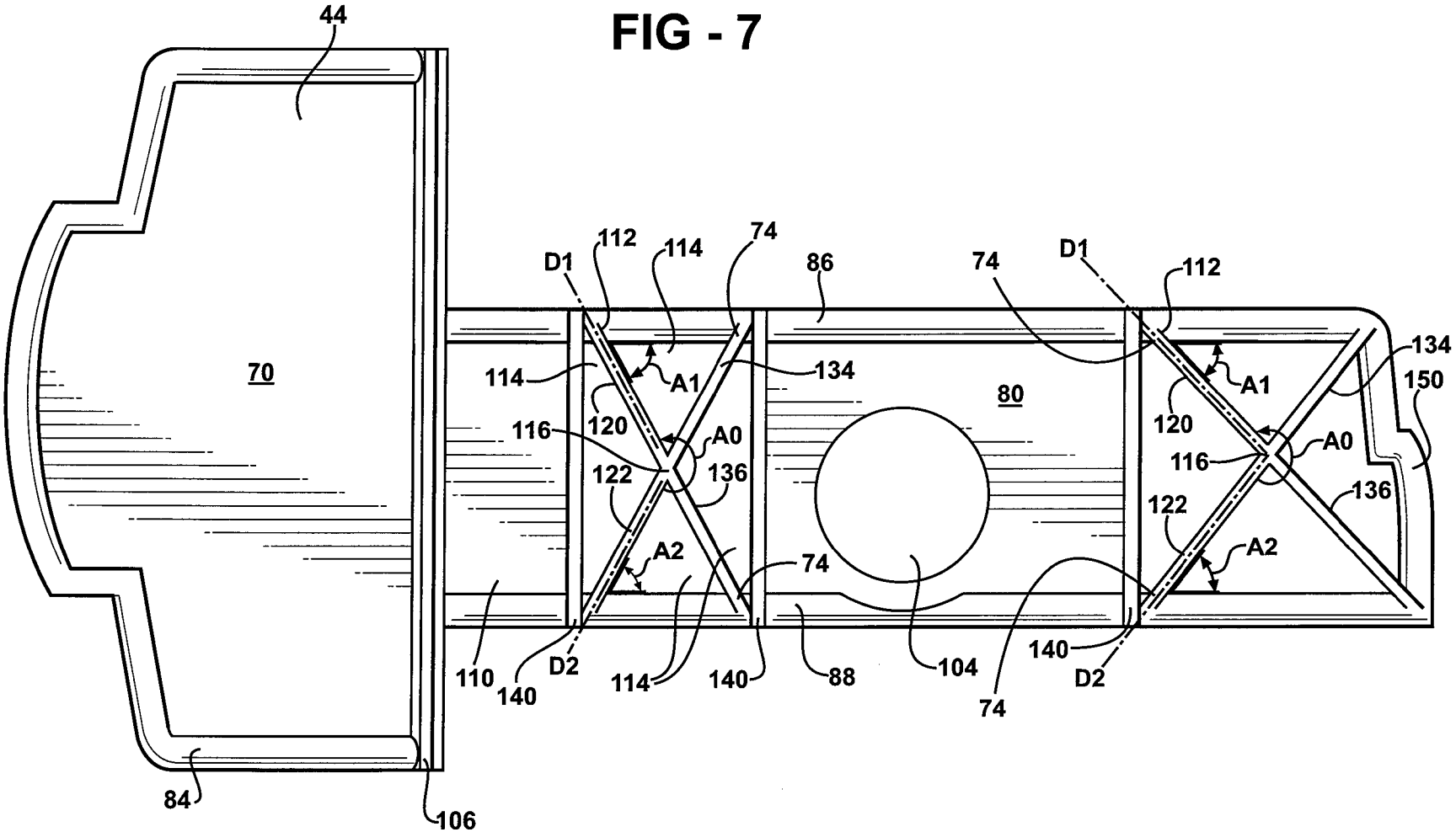
FIG. 7 is a bottom view of the astragal boot shown in FIG. 6.

As shown in FIGS. 6 and 7, each of the plurality of leg portions may extend rectilinearly. Specifically, the first leg portion 120 may extend rectilinearly in the first direction D1 and the second leg portion 122 extends rectilinearly in the second direction D2. In other words, the first leg portion 120 may be straight along the first direction D1 from the hub portion 116 to the first lateral fin 86 and the second leg portion 122 may be straight along the first direction D1 from the hub portion 116 to the second lateral fin 88.

Alternatively, as shown in FIGS. 8 and 9, each of the plurality of leg portions may extend curvilinearly. Specifically, the first leg portion 120 may extend curvilinearly in the first direction D1 and the second leg portion 122 may extend curvilinearly in the second direction D2. In other words, the first leg portion 120 may be curved and extend in the first direction D1 form the hub portion 116 to the first lateral fin 86 and the second leg portion 122 may be curved and extend in the second direction D2 from the hub portion 116 to the second lateral fin 88. In such a configuration, the first leg portion 120 may extend in the first direction D1 along an arc Y1 and the second leg portion 122 may extend in the second direction D2 along the arc Y1. It should be appreciated that the first and second leg portions 120, 122 may extend along a first and second arc, respectively, with the first arc being different than the second arc without departing from the nature of the present invention.

As shown in FIGS. 6 and 7, the astragal boot 44 may include a primary fin 140 with the primary fin 140 extending from the first lateral fin 86 to the second lateral fin 88. The astragal boot 44 may include a plurality of primary fins 140.

The distal end 74 of the first leg portion 120 may be joined to the first lateral fin 86 and the primary fin 140 and the distal end 74 of the second leg portion 122 may be joined to the second lateral fin 88 and the primary fin 140. In other words, the first leg portion 120 extends from the hub portion 116 to an intersection of the primary fin 140 and the first lateral fin 86 and the second leg portion 122 extends from the hub portion 116 to an intersection of the primary fin 140 and the second lateral fin 88. In such a configuration, the auxiliary fin 112 and the primary fin 140 reinforce each other and urge each other in contact with the threshold 38.

Each of the primary fins 140 is flexible and may project downwardly from the platform 68 for sealing engagement with the threshold 38 when the semi-active door 34 is in the closed position. Each of the primary fins 140 may project downwardly a greater distance than the lateral fins 86, 88. The primary fins 140 increase the likelihood of prevention of penetration of the elements between the astragal boot 44 and the threshold 38 and into the building 26.

It should be appreciated that the primary fins 140 may be continuous with and attached to the lateral fins 86, 88. Alternatively, the primary fins 140 may be discontinuous with the lateral fins 86, 88 and adjacent to and in contact with the lateral fins 86, 88. For example, the primary fins 140 may be discontinuous from the lateral fins and tightly pressed against the lateral fins 86, 88.

Each of the primary fins 140 is flexible such that when the semi-active door 34 is in the closed position, each primary fin 140 flexes against the threshold 38. The lateral fins 86, 88 hold each primary fin 140 in contact with the threshold 38. The effort required to swing the semi-active door 34 to the closed position is affected minimally because the auxiliary fin 112 is flexible and may flex easily against the threshold 38.

The platform 68 may be formed from a first polymeric material and the auxiliary fin 112 may be formed from a second polymeric material. The first polymeric material may different than the second polymeric material. For example, the first polymeric material may be a rigid material such as a thermoset plastic and the second polymeric material may be defined as an elastomer.

As shown in FIGS. 6-9, the astragal boot 44 includes an end fin 150 joined to and extending across the distal extremity 82 of the base portion 80 and between the sides of the base portion 80. The end fin 150 projects an equal distance from the platform 68 as the lateral fins 86, 88. The end fin 150 may seal against the threshold 38 when the semi-active door 34 is in the closed position.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. An astragal boot for mounting onto a lower end of an astragal disposed at a free end of a semi-active door in a double door set disposed over a threshold, said astragal boot comprising:

a platform;

a first and a second lateral fin spaced from each other and projecting downwardly from said platform for sealing engagement with the threshold;

a primary fin extending from said first lateral fin to said second lateral fin with said primary fin, said first and second lateral fins, and said platform defining a primary cavity with an auxiliary fin disposed in said primary cavity;

said platform defining a hole extending through the platform and into said primary cavity between said first and second lateral fins for slideably receiving a lock bolt engaging the threshold to secure the semi-active door to the threshold in a closed position;

said auxiliary fin disposed in said primary cavity and extending from said first lateral fin to said second lateral fin dividing said primary cavity into subcavities and defining an auxiliary fin edge extending from said first lateral fin to said second lateral fin for sealing engagement with the threshold with said auxiliary fin including a first and second leg portion defining a first and second edge section of said auxiliary fin edge, respectively, said first leg portion extending along a first direction defining said auxiliary fin edge along said first direction and said second leg portion extending along a second direction at an obtuse angle relative to said first direction and defining said auxiliary fin edge along said second direction.

2. The astragal boot as set forth in claim 1 wherein said first leg portion extends to said first lateral fin and wherein said second leg portion extends to said second lateral fin.

3. The astragal boot as set forth in claim 2 wherein said first and second leg portions include a distal end with said distal end of said first leg portion joined to said first lateral fin and with said distal end of said second leg portion joined to said second lateral fin.

4. The astragal boot as set forth in claim 2 wherein said first leg portion extends to said first lateral fin at a first angle relative to said first lateral fin and said second leg portion extends to said second lateral fin at a second angle relative to said second lateral fin.

5. The astragal boot as set forth in claim 4 wherein both of said first angle and said second angle are non-right angles.

6. The astragal boot as set forth in claim 5 wherein said first angle and said second angle have an equal magnitude.

7. The astragal boot as set forth in claim 1 wherein said auxiliary fin includes a hub portion spaced from said first and second lateral fins with each of said first and second leg portions extending from said hub portion.

8. The astragal boot as set forth in claim 7 wherein said first leg portion extends from said hub portion to said first lateral fin and wherein said second leg portion extends from said hub portion to said second lateral fin.

9. The astragal boot as set forth in claim 8 wherein said hub portion defines a hub edge section of said auxiliary fin edge with said first edge section of said auxiliary fin edge extending from said hub edge section to said first lateral fin and said second edge section of said auxiliary fin edge extending from said hub edge section to said second lateral fin.

10. The astragal boot as set forth in claim 7 wherein said hub portion is integral with both of said first and second leg portions.

11. The astragal boot as set forth in claim 7 wherein said auxiliary fin includes a third leg portion extending from said hub portion to said first lateral fin and a fourth leg portion extending from said hub portion to said second lateral fin.

12. The astragal boot as set forth in claim 7 wherein said hub portion includes a joined hub end joined to said platform.

13. The astragal boot as set forth in claim 1 wherein said first leg portion extends rectilinearly in said first direction and said second leg portion extends rectilinearly in said second direction.

14. The astragal boot as set forth in claim 1 wherein said first leg portion extending curvilinearly in said first direction and said second leg portion extends curvilinearly in said second direction.

15. The astragal boot as set forth in claim 14 wherein said first leg portion extends in said first direction along an arc and said second leg portion extends in said second direction along said arc.

16. The astragal boot as set forth in claim 1 wherein said first leg portion extends to said first lateral fin and said second leg portion extends to said second lateral fin and wherein said first and second leg portions include a distal end with said distal end of said first leg portion joined to said first lateral fin and said primary fin and with said distal end of said second leg portion joined to said second lateral fin and said primary fin.

17. The astragal boot as set forth in claim 1 wherein both of said first and second leg portions include a joined leg end joined to said platform.

18. The astragal boot as set forth in claim 1 wherein said auxiliary fin is flexible between an unflexed position and a flexed position for flexing against the threshold.

19. The astragal boot as set forth in claim 1 wherein each of said first and second lateral fins present a lateral fin edge and define a first distance between said platform and each of said lateral fin edges and wherein said auxiliary fin defines a second distance between said platform and said auxiliary fin edge with said second distance greater than said first distance for flexing against the threshold in sealing engagement with the threshold.

20. The astragal boot as set forth in claim 1 wherein said platform is formed from a first polymeric material and said auxiliary fin is formed from a second polymeric material.

21. The astragal boot as set forth in claim 20 wherein said first polymeric material is different than said second polymeric material and wherein said second polymeric material is defined as an elastomer.

22. An astragal assembly for disposition on a free end of a semi-active door in a double-door set disposed over a threshold, said astragal assembly comprising:

an astragal presenting a lower end proximal to the threshold and walls extending upwardly from said lower end defining a profile;

a lock block slideably disposed in said astragal at said lower end for slideably engaging the threshold to secure the semi-active door to the threshold in a closed position;

an astragal boot including a platform and an attachment device attaching said astragal boot to said astragal;

a first and a second lateral fin spaced from each other and projecting downwardly from said platform for sealing engagement with the threshold;

a primary fin extending from said first lateral fin to said second lateral fin with said primary fin, said first and second lateral fins, and said platform defining a primary cavity with an auxiliary fin disposed in said primary cavity;

said platform defining a hole extending through the platform and into said primary cavity between said first and second lateral fins for slideably receiving said lock bolt;

said auxiliary fin disposed in said primary cavity and extending from said first lateral fin to said second lateral fin dividing said primary cavity into subcavities and defining an auxiliary fin edge extending from said first lateral fin to said second lateral fin for sealing engagement with the threshold with said auxiliary fin including a first and second leg portion defining a first and second edge section of said auxiliary fin edge, respectively, said first leg portion extending along a first direction defining said auxiliary fin edge along said first direction and said second leg portion extending along a second direction at an obtuse angle relative to said first direction defining said auxiliary fin edge along said second direction.

23. The astragal assembly as set forth in claim 22 wherein said first leg portion extends to said first lateral fin and wherein said second leg portion extends to said second lateral fin.

24. The astragal assembly as set forth in claim 23 wherein said first and second leg portions include a distal end with said distal end of said first leg portion joined to said first lateral fin and with said distal end of said second leg portion joined to said second lateral fin.

25. The astragal assembly as set forth in claim 22 wherein said auxiliary fin includes a hub portion spaced from said first and second lateral fins with each of said first and second leg portions extending from said hub portion.

26. The astragal assembly as set forth in claim 25 wherein said first leg portion extends from said hub portion to said first lateral fin and wherein said second leg portion extends from said hub portion to said second lateral fin.

27. The astragal assembly as set forth in claim 26 wherein said hub portion defines a hub edge section of said auxiliary fin edge with said first edge section of said auxiliary fin edge extending from said hub edge section to said first lateral fin and said second edge section of said auxiliary fin edge extending from said hub edge section to said second lateral fin.

28. The astragal assembly as set forth in claim 25 wherein said hub portion is integral with both of said first and second leg portions.

29. The astragal assembly as set forth in claim 25 wherein said auxiliary fin includes a third leg portion extending from said hub portion to said first lateral fin and a fourth leg portion extending from said hub portion to said second lateral fin.

30. The astragal assembly as set forth in claim 1 further comprising a second primary fin spaced from said primary fin in said primary cavity and extending from said first lateral fin to said second lateral fin with said auxiliary fin and said hole in said platform disposed between said primary fin and said second primary fin.

31. The astragal assembly as set forth in claim 30 wherein said primary fin and said second primary fin project downwardly from said platform a greater distance than said lateral fins for flexing against the threshold in sealing engagement with the threshold when the semi-active door is in the closed position.

32. The astragal assembly as set forth in claim 1 further comprising a head fin spaced from said primary fin and projecting downwardly from said platform with said primary fin disposed between said hole in said platform and said head fin such that the head fin overlaps and sealingly engages door sweeps on the double door set.

* * * * *

UNITED STATES PATENT AND TRADEMARK OFFICE

CERTIFICATE OF CORRECTION

PATENT NO. : 7,694,471 B2
APPLICATION NO. : 11/690617
DATED : April 13, 2010
INVENTOR(S) : James W. Meeks et al.

It is certified that error appears in the above-identified patent and that said Letters Patent is hereby corrected as shown below:

Column 11, line 2, delete “extending” and replace with -- extents --.

Column 12, line 42, delete “assembly” and replace with -- boot --.

Column 12, line 48, delete “assembly” and replace with -- boot --.

Column 12, line 54, delete “assembly” and replace with -- boot --.

Signed and Sealed this
Fourth Day of January, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,694,471 B2
APPLICATION NO. : 11/690617
DATED : April 13, 2010
INVENTOR(S) : James W. Meeks et al.

It is certified that error appears in the above-identified patent and that said Letters Patent is hereby corrected as shown below:

In the claims

Column 11, line 2, delete “extents” and replace with -- extends --.

Signed and Sealed this
Twenty-fourth Day of May, 2016

Michelle K. Lee

Michelle K. Lee
*Director of the United States Patent and Trademark Office*